US006564957B2

(12) United States Patent
Caldwell

(10) Patent No.: US 6,564,957 B2
(45) Date of Patent: May 20, 2003

(54) PORTABLE PUZZLE STORAGE CASE AND WORKSTATION

(75) Inventor: Thomas Caldwell, Rockford, IL (US)

(73) Assignee: Mississippi Packaging, LLC, Aurora, IL (US)

( * ) Notice: Subject to any disclaimer, the term of this patent is extended or adjusted under 35 U.S.C. 154(b) by 24 days.

(21) Appl. No.: 09/846,763

(22) Filed: May 1, 2001

(65) Prior Publication Data

US 2002/0163126 A1 Nov. 7, 2002

(51) Int. Cl.[7] ..... L63F 9/10; B65D 85/20
(52) U.S. Cl. ..... 213/157 R; 206/315.1
(58) Field of Search ..... 273/157 R, 153 R, 273/148 R; 206/315.1, 579, 449, 470, 490, 557

(56) References Cited

U.S. PATENT DOCUMENTS

| | | | | | |
|---|---|---|---|---|---|
| 3,792,668 | A | * | 2/1974 | Ward | 206/315.1 |
| 4,111,425 | A | | 9/1978 | Lathrop | 273/157 R |
| 4,154,339 | A | | 5/1979 | Dutra | 206/315.1 |
| 4,302,013 | A | * | 11/1981 | Kavis | 273/157 R |
| 4,436,307 | A | | 3/1984 | Caldwell | 273/157 R |
| 4,479,651 | A | * | 10/1984 | LaFleur | 273/157 R |
| 4,484,745 | A | | 11/1984 | Sleeper | 273/157 R |
| 4,503,974 | A | * | 3/1985 | Lane | 206/315.1 |
| 4,552,361 | A | * | 11/1985 | LaFleur | 273/157 R |
| 4,865,325 | A | | 9/1989 | Stolz | 273/157 R |
| D335,152 | S | | 4/1993 | Hollrah | D21/104 |
| D336,319 | S | | 6/1993 | Wenzel | D21/104 |
| 5,405,146 | A | | 4/1995 | Washington | 273/157 R |
| 5,538,248 | A | | 7/1996 | Shillito et al. | 273/157 R |
| 5,624,118 | A | | 4/1997 | Gottesman | 273/157 R |
| 5,651,547 | A | | 7/1997 | Rannelli | 273/157 R |
| 6,276,525 | B1 | * | 8/2001 | Kobeluch et al. | 206/315.1 |
| 6,364,116 | B1 | * | 4/2002 | Ng | 206/315.1 |

OTHER PUBLICATIONS

Harriet Carter Catalog, p. 4.

* cited by examiner

*Primary Examiner*—Steven Wong
(74) *Attorney, Agent, or Firm*—Leydig, Voit & Mayer, Ltd.

(57) ABSTRACT

A portable jigsaw puzzle storage case and workstation is provided generally comprising an outer cover which encloses a sorting tray and a workstation therein. The workstation generally includes an assembly tray having an assembly board and a frame. The frame extends around at least part of the outer periphery of the assembly board, and is joined thereto by an integral hinge. Preferably, the assembly tray is formed of corrugated fiberboard. Further, a method of producing an assembly tray is provided. The method generally comprises the steps of providing an assembly board having a first half and a second half, cutting out an inner section of the first half to define an outer peripheral strip, scoring the assembly board at a boundary line where the first and second half meet, and attaching the outer peripheral strip to the second half to form a frame on the second half of the assembly board. The cutting step may further include the step of cutting the inner section to form a sorting tray.

18 Claims, 5 Drawing Sheets

PORTABLE PUZZLE STORAGE CASE AND WORKSTATION

FIELD OF THE INVENTION

The present invention relates generally to storage cases for puzzles, and more particularly relates to portable cases also serving as puzzle workstations.

BACKGROUND OF THE INVENTION

The present invention relates to a puzzle caddy for facilitating assembly of the pieces of a jigsaw puzzle and for enabling the assembled or partially assembled puzzle to be stored and/or transported from place to place. One such exemplary device is disclosed in U.S. Pat. No. 4,436,307.

While many puzzle caddies have enjoyed much commercial success, they are not without their drawbacks. For example, many puzzle caddies have complicated structures for protecting the puzzle. Such puzzle caddies require significant amounts of manual labor to construct, resulting in lower productivity and higher cost. Similarly, components selected for constructing these devices often increase costs even further, and may require the manual installation of that component. Accordingly, there exists a need for a sturdy yet easily formed puzzle caddy having a low cost of production.

BRIEF SUMMARY OF THE INVENTION

In light of the above, it is a general aim of the present invention to provide an improved portable puzzle storage case that allows assembled and unassembled pieces to be stored or transported from place-to-place without disturbing the position of the pieces, and that is simple and cost effective to produce.

In that regard, it is a further object of the present invention to provide such a portable puzzle storage case that can be produced inexpensively and with minimal waste.

In accordance with these objects, the present invention provides a portable jigsaw puzzle storage board generally comprising an outer cover which encloses a sorting tray and a workstation therein. The workstation generally includes an assembly tray having an assembly board and a frame. The frame extends around at least part of the outer periphery of the assembly board, and is joined thereto by an integral hinge.

According towards more detailed aspects of the puzzle storage board, the assembly board has four sides, the frame extending around three of the four sides. Preferably, the hinge joins the assembly board and frame along the fourth, unframed, side of the assembly board. The frame includes a first strip connecting opposing second and third strips, the second and third strips being joined to the assembly board by integral hinges. A bottom surface of the frame is integrally joined to a top surface of the assembly board to form the integral hinge. Additionally, the workstation may further include a second assembly tray identical to the first assembly tray, each of the tray sized to hold a first standard size puzzle. The first and second assembly trays are positionable proximate each other along the unframed sides to form a combined assembly tray sized for a second standard size puzzle larger than the first standard size puzzle. Preferably, the assembly tray is formed of corrugated fiberboard.

In accordance with another embodiment of the present invention, a method of producing an assembly tray is provided. The method generally comprises the steps of providing an assembly board having a first half and a second half, cutting out an inner section of the first half to define an outer peripheral strip, scoring the assembly board at a boundary line where the first and second half meet, and attaching the outer peripheral strip to the second half to form a frame on the second half of the assembly board.

According to more detailed aspects of this embodiment, the attaching step includes folding the outer peripheral strip about the boundary line and toward the second half, and also includes applying an adhesive to one of the outer peripheral strip and the second half. Preferably, the cutting step and scoring step are performed substantially simultaneously. The scoring step defines integral hinges linking the second half of the assembly board to the outer peripheral strip. The cutting step may further include the step of cutting the inner section to form a sorting tray.

Other objectives and advantages of the invention will become more apparent from the following detailed description when taken in conjunction with the accompanying drawings.

BRIEF DESCRIPTION OF THE DRAWINGS

The accompanying drawings incorporated in and forming a part of the specification illustrate several aspects of the present invention, and together with the description serve to explain the principles of the invention. In the drawings.

While the invention will be described in connection with certain preferred embodiments, there is no intent to limit it to those embodiments. On the contrary, the intent is to cover all alternatives, modifications and equivalents as included within the spirit and scope of the invention as defined by the appended claims.

DETAILED DESCRIPTION OF THE INVENTION

Figure 1:
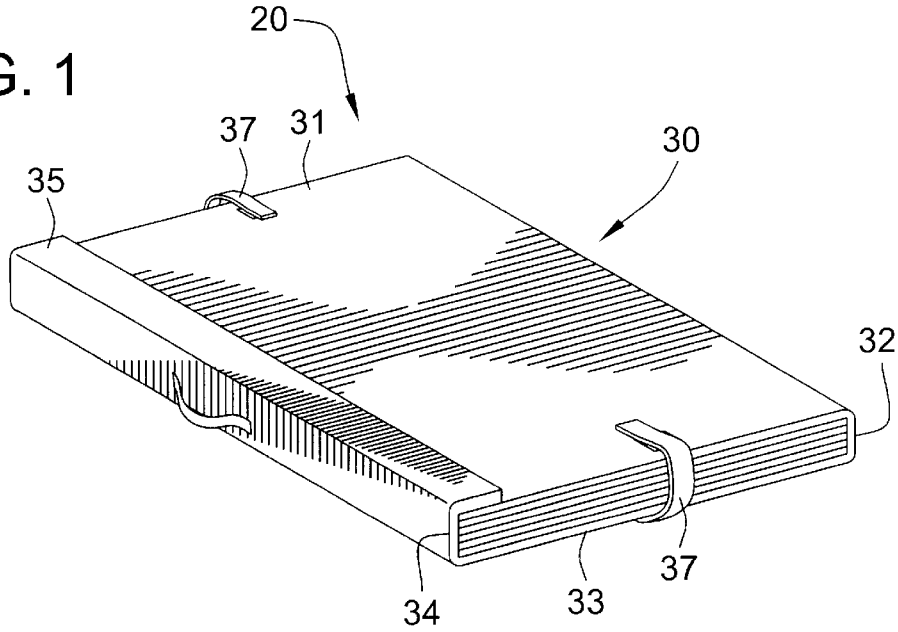
FIG. 1 illustrates a perspective view of a portable jigsaw puzzle storage board constructed in accordance with the teachings of the present invention.
Figure 2:
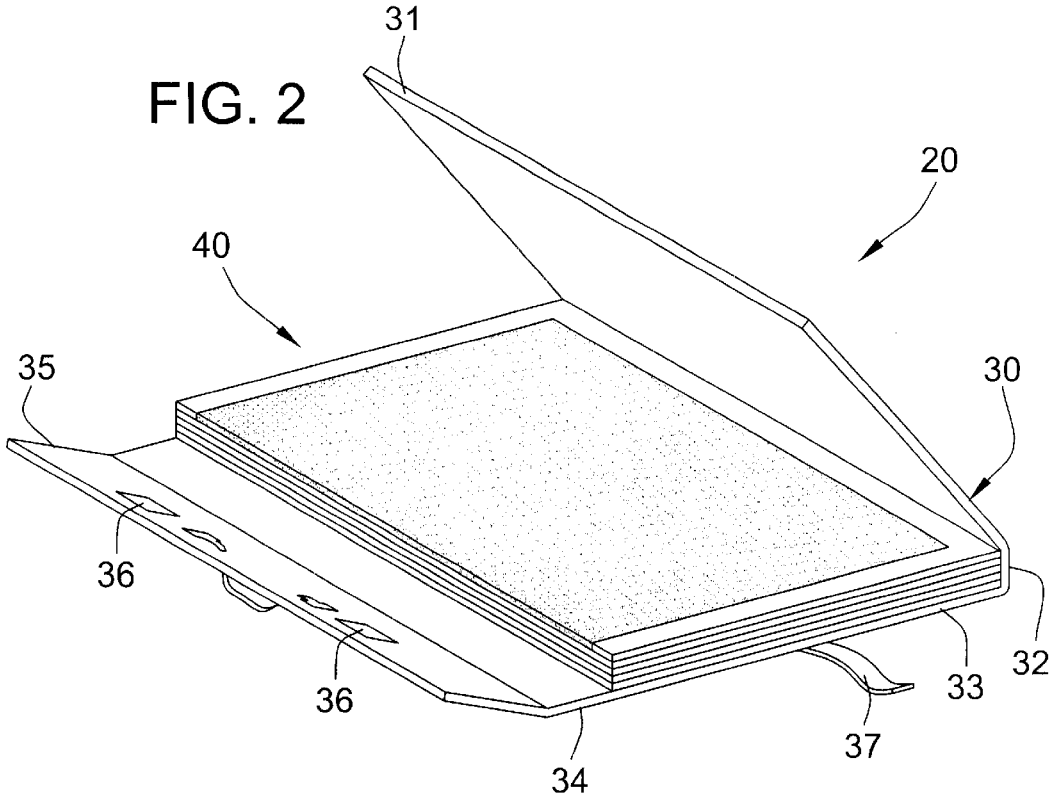
FIG. 2 illustrates a perspective view of the storage board of FIG. 1 in a partially open position.
Figure 3:
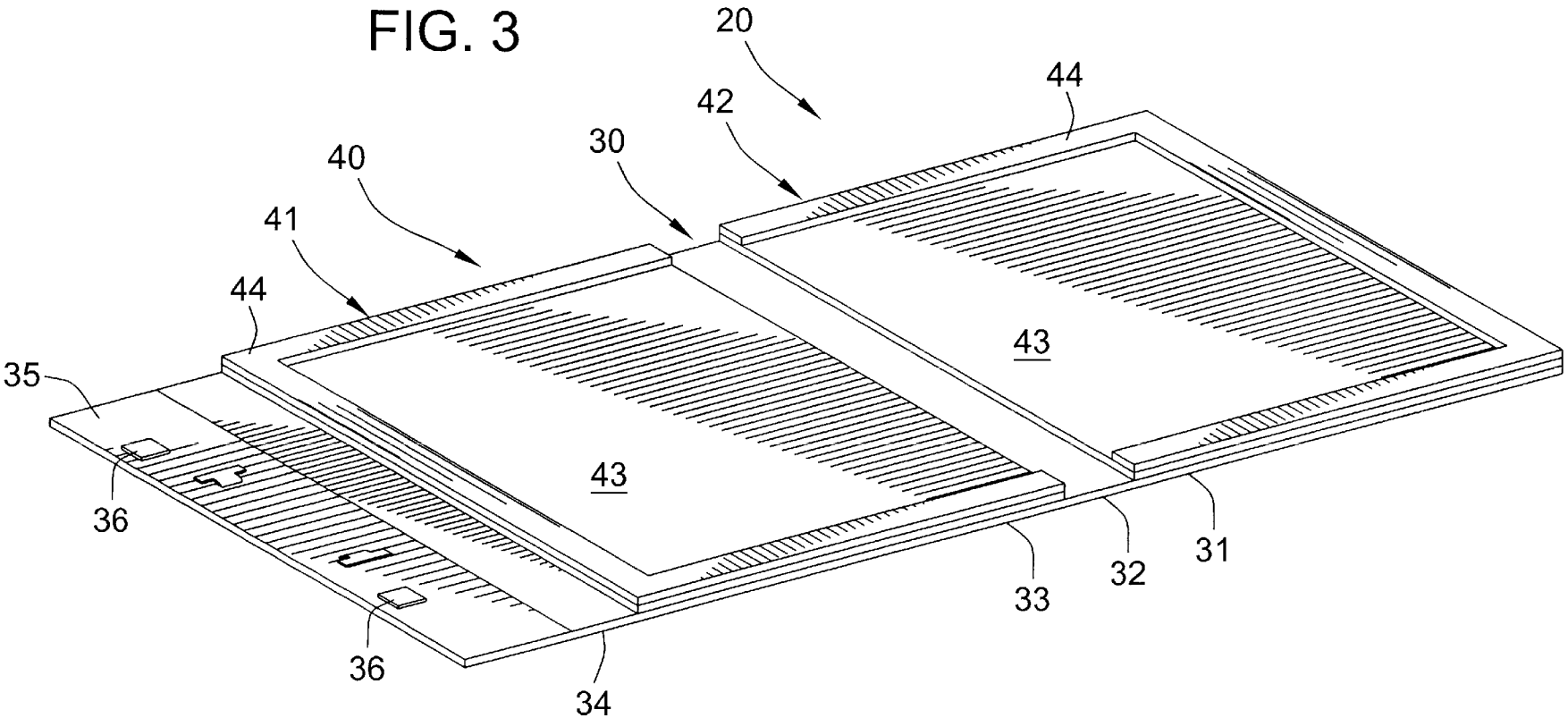
FIG. 3 illustrates the storage board at FIG. 1 in an open and active position.

Referring now to the drawings, FIGS. 1–3 illustrate an embodiment of the portable jigsaw puzzle storage board 20 constructed in accordance with the teachings of the present invention. FIG. 1 depicts the puzzle storage board 20 in a stored or closed position while FIG. 2 represents the puzzle storage board 20 having the cover 30 opened. FIG. 3 illustrates the puzzle storage board 20 in an active position wherein puzzles may be assembled. The puzzle storage board 20 generally comprises a cover 30, a workstation 40, and at least one sorting tray 50. In the illustrated embodiment, the sorting tray comprises a first sorting tray 51 and a second sorting tray 52.

The cover 30 generally comprises a top wall 31 and a bottom wall 33 which are connected by a side wall 32. A second side wall 34 connects the bottom wall 33 to a flap 35 which selectively engages the top wall 31 to close or open the puzzle storage board 20. The flap 35 generally includes at least one fastener 36, which in the preferred embodiment comprises a pair of Velcro® tabs 36. The fastener 36 allows the flap 35 to be selectively connected to the top wall 31. Preferably, a second fastener 37 is employed to mechanically link the bottom wall 33 to the top wall 31. In the illustrated embodiment, the bottom wall 33 has two opposing Velcro® strips 37 attached thereto which selectively engage corresponding strips on the top wall 31. The first and second fasteners allow the top and bottom walls 31, 33 of the cover 30 to supply a compressive force to the work station 40 and sorting tray 50 held therebetween. Preferably, the case 30, workstation 40, and sorting tray 50 are constructed of corrugated fiberboard which is sturdy, enough to transmit the compressive force, yet has sufficient ductility to prevent damage to puzzle pieces. The side walls are sized to be slighter smaller than the combined thickness of the stacked work station 40 and sorting tray 50, including puzzle pieces, to assist inducing the above-noted compressive force.

Figure 6:
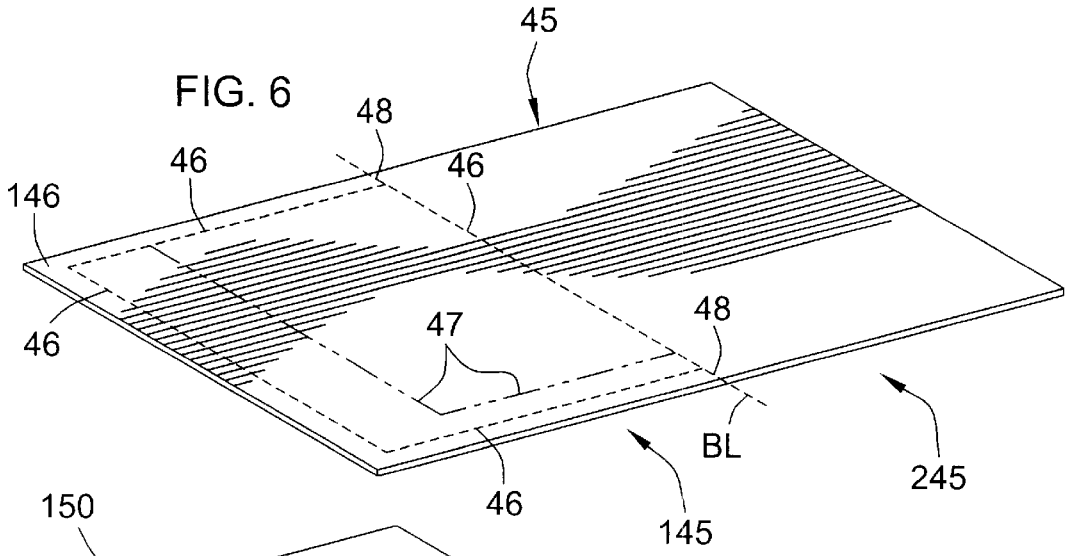
FIGS. 6–8 illustrate the construction of an assembly tray of the storage board depicted in FIG. 1.
Figure 7:
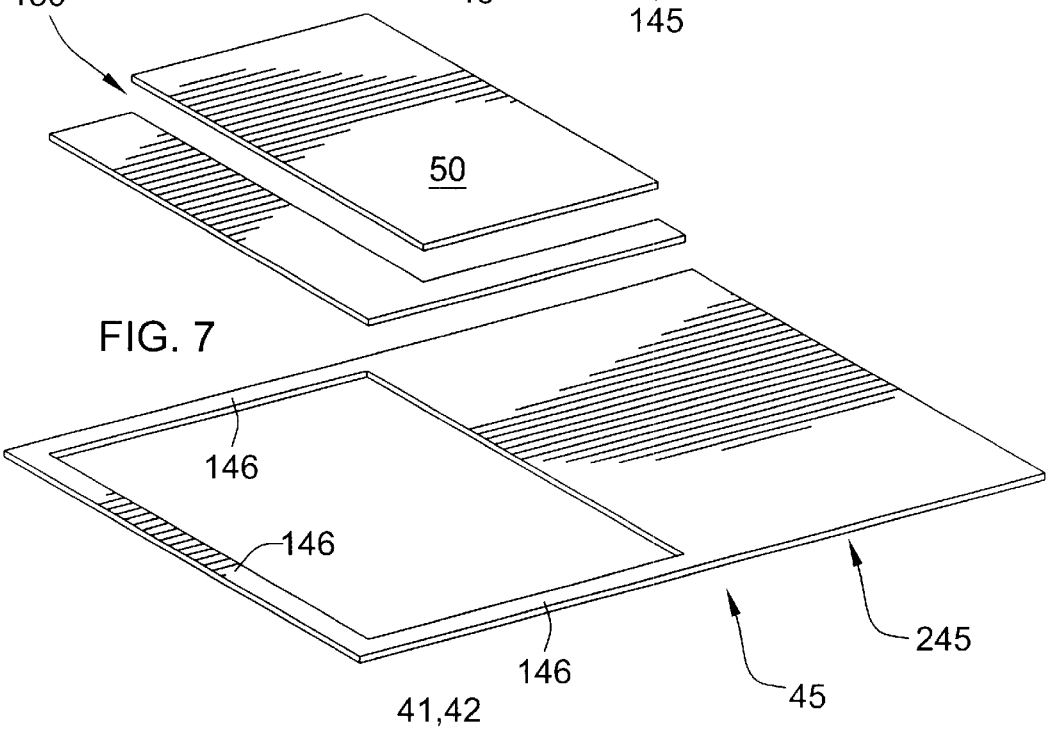

As shown in FIG. 3, the workstation 40 generally comprises an assembly tray, and in the illustrated embodiment comprises a first assembly tray 41 and a second assembly tray 42. Each of the first and second assembly trays 41 and 42 are generally identical, and their construction will be discussed in more detail herein with reference to FIGS. 5–7. Each tray 41, 42 includes an assembly board 43 having a frame 44 extending a portion, preferably around three sides, of the periphery of the assembly board 43. The working surface given by the assembly board 43, for each of the first and second assembly trays 41, 42, is preferably sized at 19"×24½", sized for a standard 500 piece puzzle. The trays 41, 42 are framed only on three sides such that the open side of one tray may be placed adjacent the open side of the other tray to form a large work station 40. The working surface of the combined assembly boards is 24¼"×38", sized for a large puzzle containing 1,000 pieces.

Figure 4:
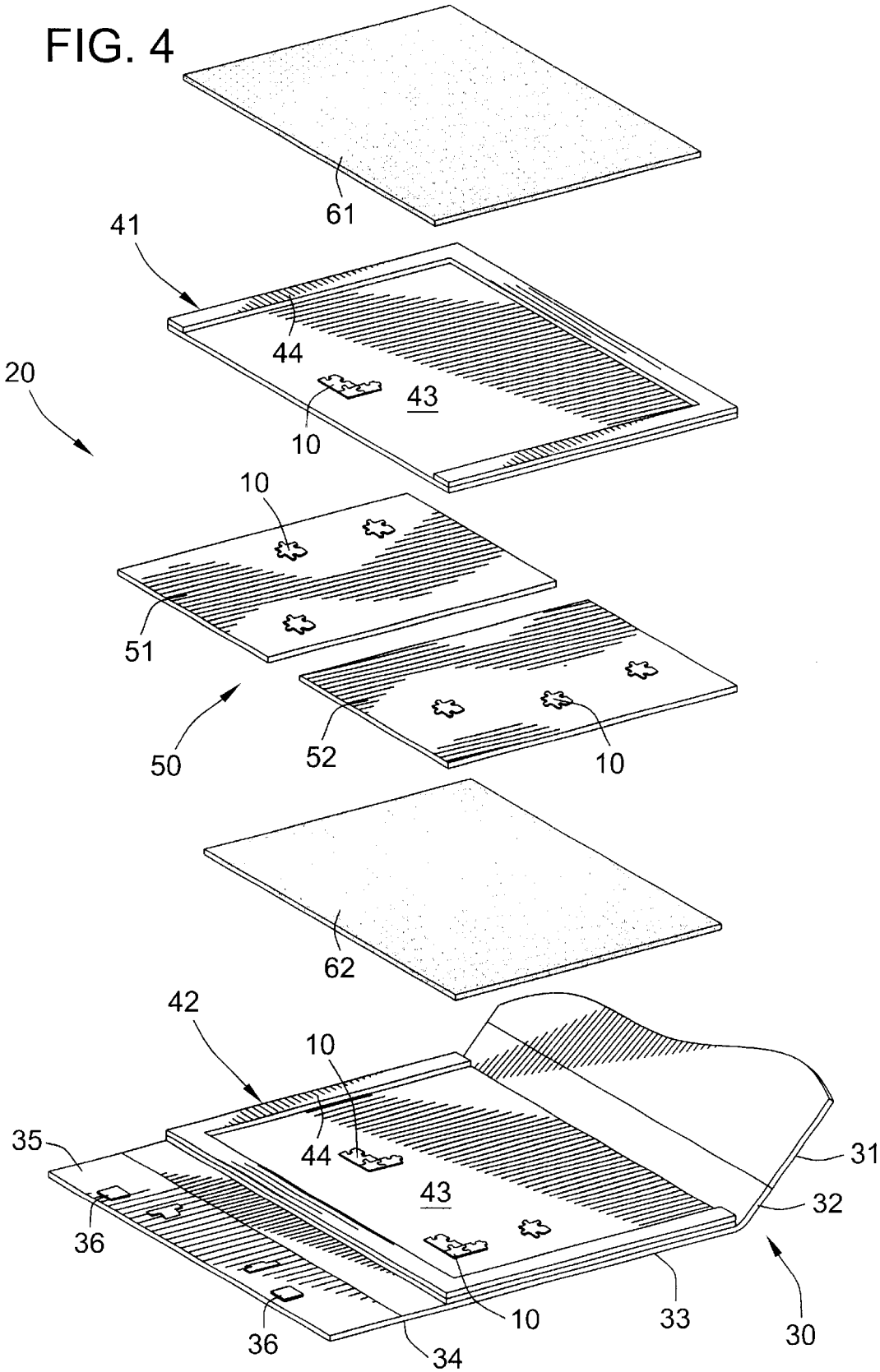
FIG. 4 illustrates an exploded view of the storage board of FIG. 1 depicting the assembly of the storage board.

FIG. 4 depicts an exploded view of the storage board of FIG. 1 to reveal the assembly of the storage board, which will be described from bottom to top. The cover 30 is shown, partially cut away, and is opened to reveal the contents of the puzzle storage case 20. The bottom wall 33 of the cover 30 is sized to correspond with the assembly trays 41, 42, and in the preferred embodiment has one storage tray 42 permanently affixed thereto, preferably by applying an adhesive to a bottom surface of the assembly tray 42 or the top surface of the bottom wall 33. Within the frame 44 the assembly board 43 will carry assembled or partially assembled pieces 10. To hold these pieces 10 in place, a sheet of anti-skid material 62, such as a foam based material, is sized to fit within the unframed or working surface of the assembly board 43, i.e., within the frame 44, to engage the puzzle pieces 10 and hold them in place. The sorting tray 50, which preferably comprises two flat boards or assembly trays 51, 52 are preferably placed on top of the assembly 42 and the anti-skid sheet 62, and are sized to be placed side by side and cover the same square area as the assembly tray 42. The sorting trays 51, 52 typically will hold the unassembled pieces 10 of the puzzle. Next, the other assembly tray 41 is placed on top of the sorting trays 51, 52, and more specifically directly on top of the unassembled puzzle pieces 10. The assembly tray 41 will also typically included assembled puzzle pieces 10, and thus another sheet of anti-skid material 61 is placed on the assembly board 43 within the frame 44 to hold the pieces 10 in place. Finally, in order to transport the entire puzzle storage case and workstation 20, the top wall 31 will be folded over and placed on top of assembly tray 41 and its sheet of anti-skid material 61. The flap 35 is then folded over to engage the top wall 31 and is held in place by fasteners 36. As previously noted, the side walls 32, 34 are sized such that when the cover 30 is closed, a compressive force is induced on the contents of the container to assist in holding the puzzle pieces 10 in place. Additionally, the second set of fasteners 37 may be engaged to temporarily fasten the bottom wall 33 to the top wall 31. It will be noted that even though the puzzle pieces 10 on the sorting trays 51, 52 are not in contact with any anti-skid material, the compressive force is sufficient to hold them in place without the need for such material.

Figure 5:
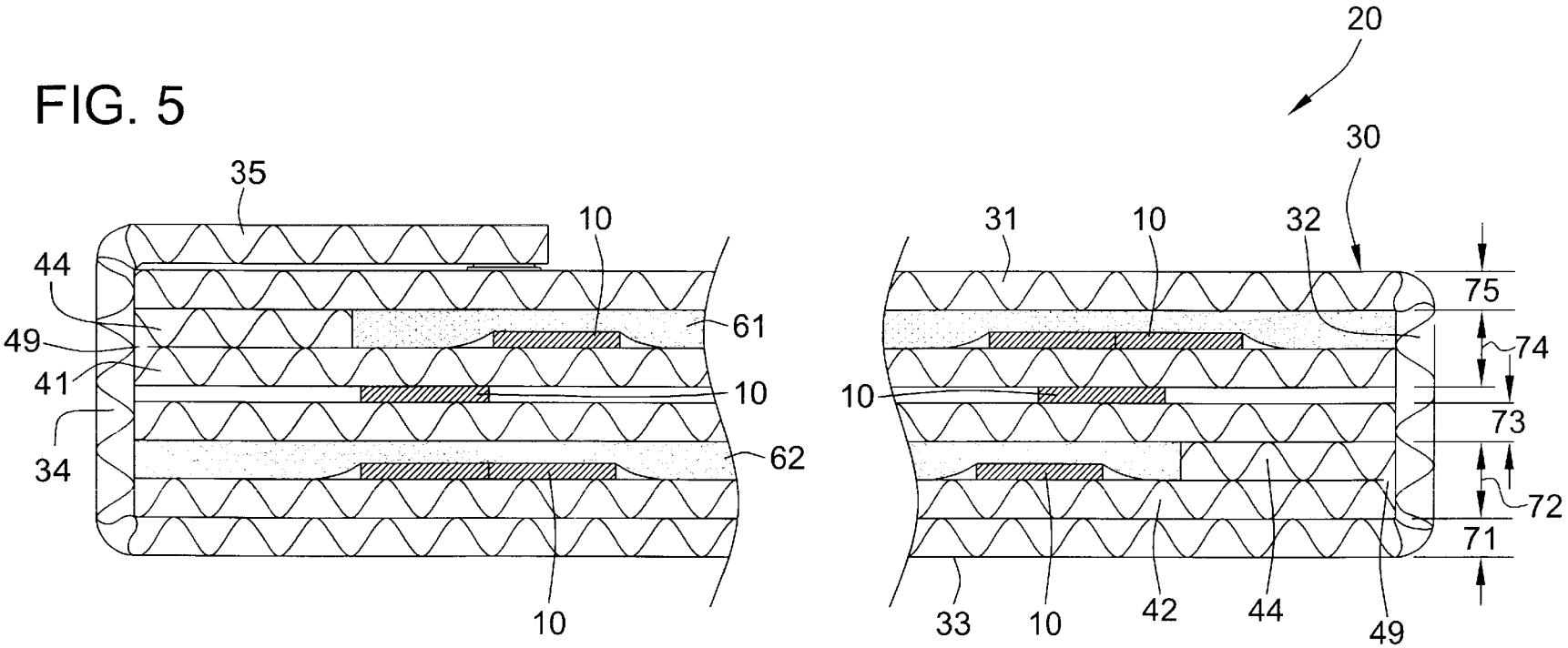
FIG. 5 illustrates a cross-sectional end view of the storage board of FIG. 1.

Turning to FIG. 5, a cross-sectional end view of the puzzle storage board 20 is depicted. When in the closed position, the storage board 20 generally forms five layers. A first layer 71 comprises the bottom wall 33 of the cover 30. The second layer 72 generally comprises a first assembly tray 41 which includes an assembly board 43 and frame 44. The second layer 72 further includes a first sheet of anti-skid material, such as a foam-based material, which is sized to fit in the unframed area of the first assembly tray 41. The first sheet 61 is generally thicker than the thickness of the frame 44, although in a closed position the sheet 61 is compressed to hold the puzzle pieces in place and become generally flush with the top surface of the frame 44. A third layer 73 generally comprises the at least one sorting tray 50, and in the preferred embodiment comprises the first and second sorting trays 51, 52 which are sized to both fit side by side such that their combined width match the width of the cover 30 and the puzzle storage board 20. A fourth layer 74 comprises the second assembly tray 42 and a second sheet of anti-skid material 62, which is sized and constructed identically to the second layer. A final fifth layer generally comprises the top wall 31 of the cover 30. When in the closed position, the puzzle storage board 20 securely holds puzzle pieces therein, by virtue of the top and bottom wall applying a compressing force to the second, third and fourth layers contained between the walls. The sheets of anti-skid material 61, 62 are slightly compressed to securely hold puzzle pieces within the assembly trays 41, 42. The loose pieces on sorting trays 51, 52 are securely held in place by the clamping or compressive force between the sorting trays 51, 52 and the bottom surface of the second assembly tray 42. It has been found that enough compressive force is present and evenly distributed throughout the entire puzzle storage board 20 that a sheet of anti-skid material is not necessary to securely hold puzzle pieces in place on the sorting trays 51, 52.

Figure 8:
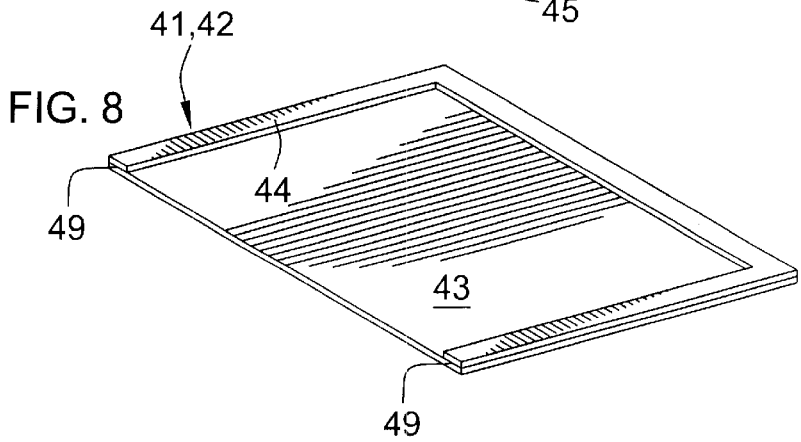

In accordance with an aspect of the present invention, the frame 44 of the assembly trays 41, 42 is also comprised of corrugated fiberboard and is integrally linked to the assembly board 43. The frame 44 is generally rather wide, preferably in the range of 1 to 2 inches. It has been found that such a wide frame provides added security to the puzzle within the assembly board area 43 of the assembly trays 41, 42, As will be described with reference to FIGS. 6–8, each of the assembly trays 41, 42 is constructed in a novel manner. A starting board 45 comprises a first half 145 and a second half 245 divided by a boundary line BL. A first cut shown by dotted lines 46 is made in the first half 145 of the starting board 45 to leave an outer peripheral portion 146. A second cut 47 is made to the cut out portion 150 (FIG. 6) to form a sorting tray 50. Finally, a third score 48 is made on one side, the bottom side as shown in the figures, of the starting board 45 at the boundary line BL where the second half meets the outer peripheral portion. The outer peripheral strip 146 is then folded about the boundary line BL towards the second half 245, the top side of the starting board 45 above the scores 48 forming an integral hinge 49. Hence a bottom surface of the frame 44 and the top surface of the assembly board 43 define a hinge 49 integral to both structures. The outer peripheral strip 146 is then affixed to the second half 245 to form the frame 44 of the assembly tray 41, 42. Preferably, the outer peripheral strip 146 is adhesively attached, typically by glue, to the second half 245 of the starting board 45, to form the assembly board 43 having a frame 44, representing one of the assembly trays 41, 42.

The assembly trays 41, 42, and hence the sorting tray 50, are thus formed in a single operation with a single sheet of material, and minimal waste is produced. The cuts and scores 46, 47 and 48 may be formed by any well known means, although it has been found preferable to die cut the starting board 45. By die cutting, a one time operation is made to make all the necessary cuts and scores. Therefore, the cutting steps and scoring steps are performed substantially simultaneously. Alternately, the cuts 46, 47 can be made, and then the score 48 may be made to form the integral hinge 49. Once the cutting and scoring steps are performed, the outer peripheral portion 146 may be attached to the second half 245 by applying an adhesive to one of the top surface of the outer peripheral portion 146 and the top surface of the outer edge of the second half 245, and then the outer peripheral portion 146 is folded about the boundary line BL and score 48. These steps of gluing and folding may also be performed substantially simultaneously. Importantly, by utilizing this method, there is no need to measure the outer peripheral portion 146 which forms the frame 144, as it has been formed from a first half 145 that is substantially identical in size to a second half 245 as divided by the boundary line BL. Furthermore, the amount of glue needed, and the placement thereof, is easily determined and preprogrammed.

All of the references cited herein, including patents, patent applications, and publications, are hereby incorporated in their entireties by reference.

The foregoing description of various embodiments of the invention has been presented for purposes of illustration and description. It is not intended to be exhaustive or to limit the invention to the precise embodiments disclosed. Numerous modifications or variations are possible in light of the above teachings. The embodiments discussed were chosen and described to provide the best illustration of the principles of the invention and its practical application to thereby enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly, legally, and equitably entitled.

What is claimed is:

1. A portable jigsaw puzzle storage board comprising:

an outer cover;

a workstation comprising an assembly tray, the assembly tray including an assembly board and a frame extending around at least part of the outer periphery of the assembly board, the frame and assembly board joined by an integral hinge, and a bottom surface of the frame is integrally joined to a top surface of the assembly board to form the integral hinge.;

a sorting tray;

the storage board having a storage position wherein the outer cover encloses the sorting tray and workstation therein.

2. The puzzle storage board of claim 1, wherein the assembly board has four sides, and wherein the frame extends around three of the four sides.

3. The puzzle storage board of claim 2, wherein the hinge joins the assembly board and frame along the fourth, unframed, side of the assembly board.

4. The puzzle storage board of claim 2, wherein the frame is attached to the storage board at the two points by two integral hinges.

5. The puzzle storage board of claim 1, wherein the frame includes a first strip connecting opposed second and third strips, the second and third strips being joined to the assembly board by integral hinges.

6. The puzzle storage board of claim 1, wherein the hinge is formed on unframed side of the assembly board.

7. The puzzle storage board of claim 1, wherein the assembly tray is formed of corrugated fiberboard.

8. The puzzle storage board of claim 1, wherein the assembly tray is formed from a single sheet of material having first and second sections, the first section forming the assembly board and the second section forming the frame.

9. The puzzle storage board of claim 8, wherein the hinge is formed by scoring one side of the single sheet along a line corresponding to the first section meeting the second section.

10. The puzzle storage board of claim 9, wherein the frame is formed by removing an inner portion of the second section to leave an outer peripheral strip that is folded over and attached to the first section of the assembly board.

11. The puzzle storage board of claim 1 further comprising one or more sheets of anti-skid material sized to fit within an unframed portion of the assembly tray.

12. The puzzle storage board of claim 1 wherein the puzzle storage board forms a plurality of layers when in a storage position including one or more of:

a first layer including a bottom wall of the outer cover;

a second layer including the assembly tray;

a third layer including the sorting tray, the sorting tray capable of holding unsecured puzzle pieces thereon;

a fourth layer including a second assembly tray; and a fifth layer including an upper wall of the outer cover.

13. The puzzle storage board of claim 12 wherein one or more of the assembly trays includes one or more sheets of anti-skid material.

14. The puzzle storage board of claim 12, wherein the first and fifth layers induce a compressive force therebetween on the second, third and fourth layers.

15. The puzzle storage board of claim 12, further comprising at least two side walls, the side walls sized to induce a compressive force.

16. The puzzle storage board of claim 14, wherein the compressive force secures the unsecured puzzle pieces of the third layer.

17. The puzzle storage board of claim 13, wherein a storage position enables the unsecured puzzle pieces of the third layer, to avoid contact with the anti-skid material.

18. The portable jigsaw puzzle storage board of claim 12 wherein the storage board is formed in a single operation with a single sheet of material.

* * * * *